United States Patent [19]

Bradley

[11] 4,253,696

[45] Mar. 3, 1981

[54] MOTORIZED LEVER-ACTION VERTICAL AXIS COIL GRAB

[75] Inventor: Harvey Bradley, East Prospect, Pa.

[73] Assignee: Bradley Lifting Corp., York, Pa.

[21] Appl. No.: 119,216

[22] Filed: Feb. 7, 1980

[51] Int. Cl.[3] ..... B66C 1/44

[52] U.S. Cl. ..... 294/103 CG

[58] Field of Search ..... 294/86 R, 88, 103 R, 294/103 CG, 104, 106, 110 R; 414/626, 910, 911

[56] References Cited

U.S. PATENT DOCUMENTS

| | | | |
|---|---|---|---|
| 2,803,489 | 8/1957 | Zito et al. | 294/103 R |
| 2,830,842 | 4/1958 | Heppenstall et al. | 294/104 |
| 2,906,555 | 9/1959 | Heppenstall | 294/103 CG X |
| 3,037,806 | 6/1962 | Anderson | 294/103 R |
| 3,076,674 | 2/1963 | Anderson | 294/103 R |
| 3,153,555 | 10/1964 | Kaplan et al. | 294/103 CG X |

FOREIGN PATENT DOCUMENTS

| | | | |
|---|---|---|---|
| 640819 | 5/1962 | Canada | 294/103 CG |

*Primary Examiner*—Johnny D. Cherry
*Attorney, Agent, or Firm*—Samuel M. Learned, Jr.

[57] ABSTRACT

A motorized lever-action vertical axis coil grab manipulated in suspended disposition from an overhead crane by a single operator from a remote control location for clampably engaging for lifting and displacement from one location to another upright standing wrapped metal material coils of various size and dimension, with initial grab engagement of any particular coil to be moved by a motor-driven compressive clamping of the coil overply wall thickness to remove therefrom any wrap slack sponginess preparatory to tong latch release of the grab lever-acting self-gripping force translating tong linkage assembly such that no extension of the tong linkage assembly thereof will be wasted in taking up coil wrap slack but rather be substantially translated as increasing clamp compression on the coil wall thickness in a gripping force transmission sufficient to lift the coil without the convoluted laminate wrap structure thereof slipping apart upon coil elevation for movement, wherein the grab hereof further embodies as a feature thereof a tong latch load sensing switch assembly automatically operable to cut crane hoist motor power in an event where the tong latch does not properly cycle and release the lever-acting tong linkage assembly to effect a self-gripping force translation upon grab elevation of the motor-driven compressively clamped coil.

11 Claims, 12 Drawing Figures

12
18
20
10
16
110
34
30
120
92
56
80
88
86
62
32
50
60
122
90
54
58
98
96
72
82
70
102
112
74
66
64
79
84
22
68
52
104
94
106
26
28
22
24
78
114
76
36
46
36
44
48
14
40
42
38

12
18
10
16
20
34
30
110
32
80
56
120
92
88
86
50
62
60
122
90
54
58
72
82
70
68
66
112
74
64
102
84
52
104
22
94
100
106
22
78
26
76
28
36
46
114
36a
44
48
40
42a
14
38

12
18
10
16
20
34
30
32
110
50
62
60
54
58
80
56
120
118
88
86
122
90
98
96
116
70
72
66
64
82
112
84
94
68
52
102
104
22
74
24
106
22
26
36
28
78
76
36a
46
114
44
48
40
42a
14
38

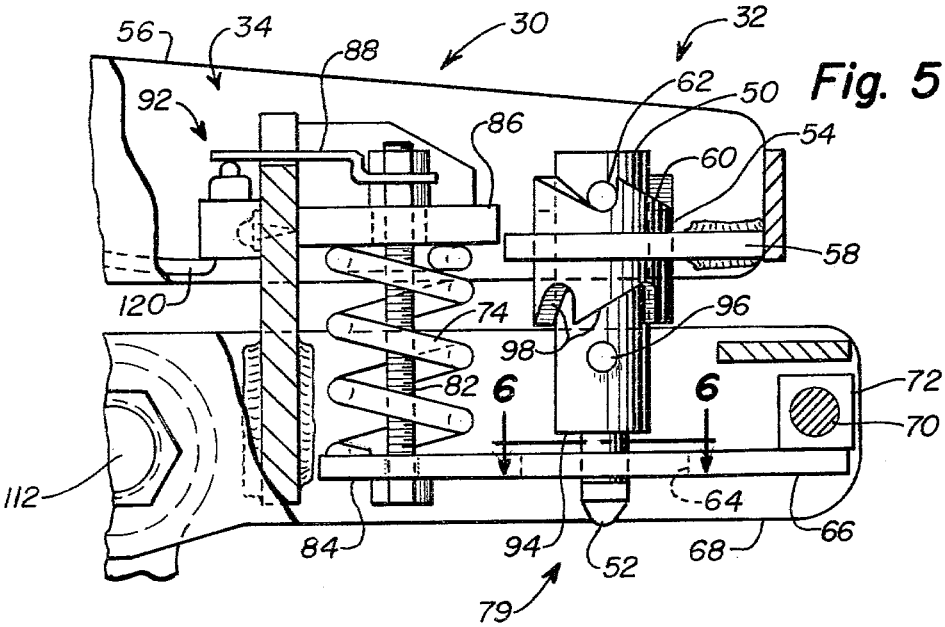
Fig. 5
Fig. 6
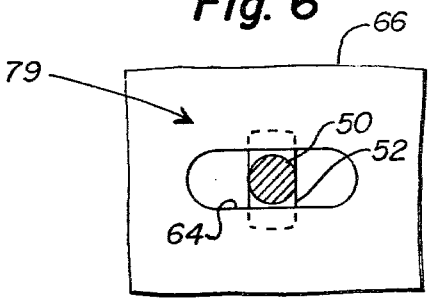
Fig. 8
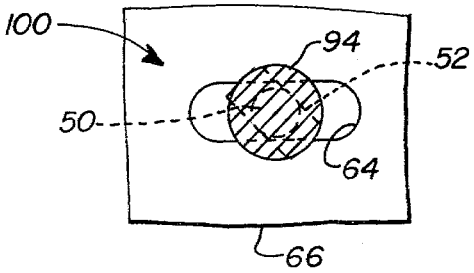
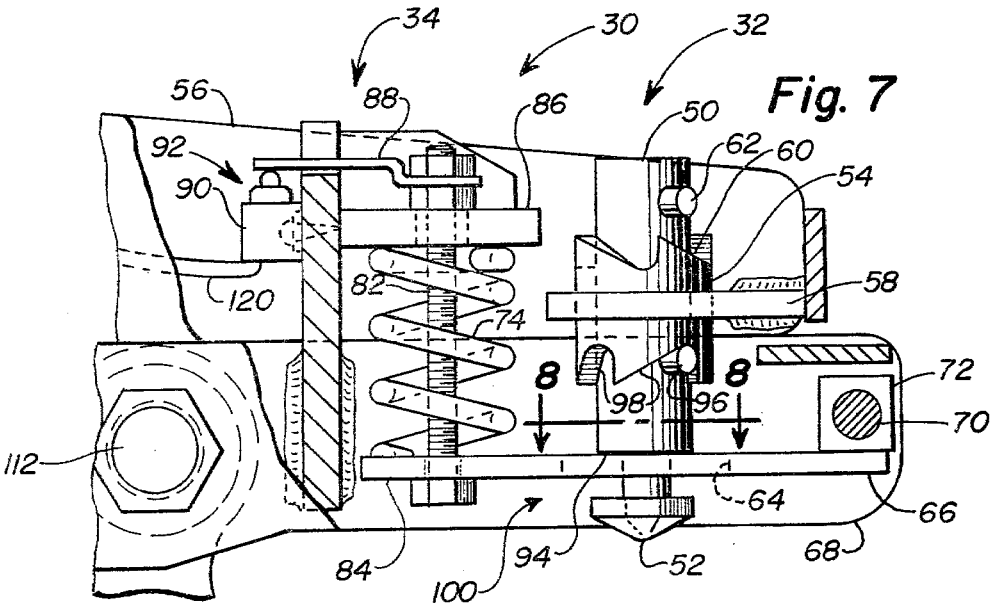
Fig. 7

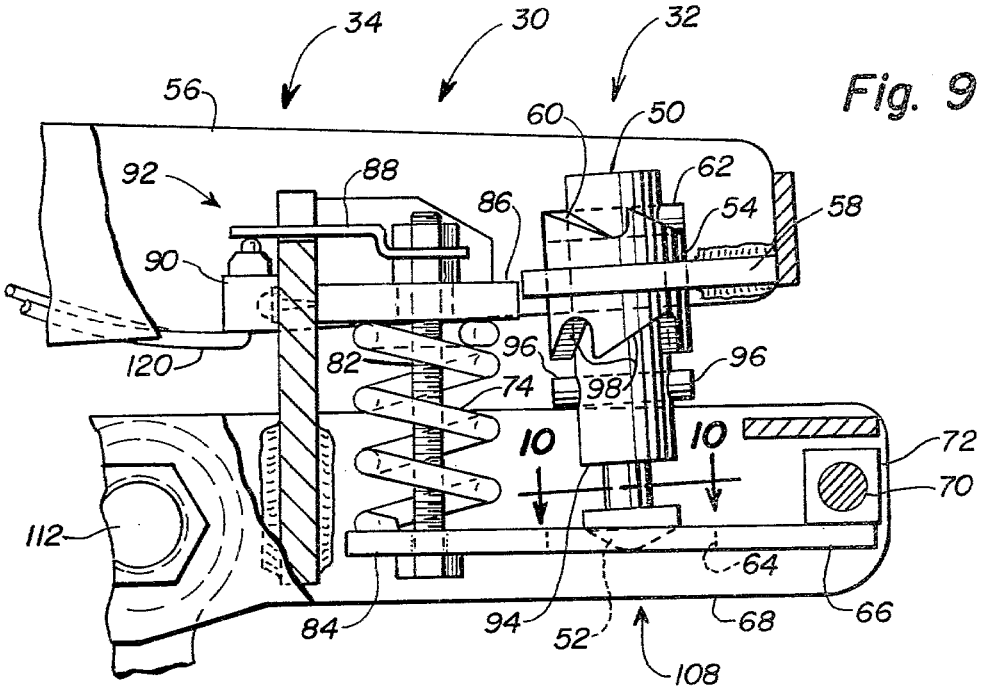
Fig. 9
Fig. 10
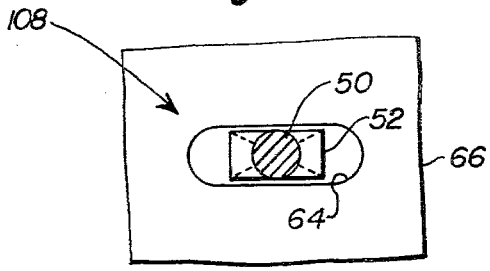
Fig. 12
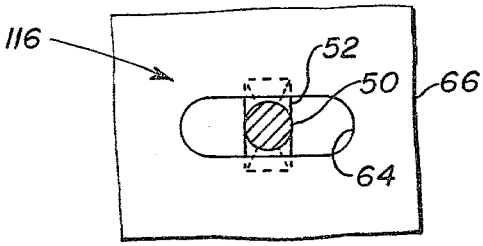
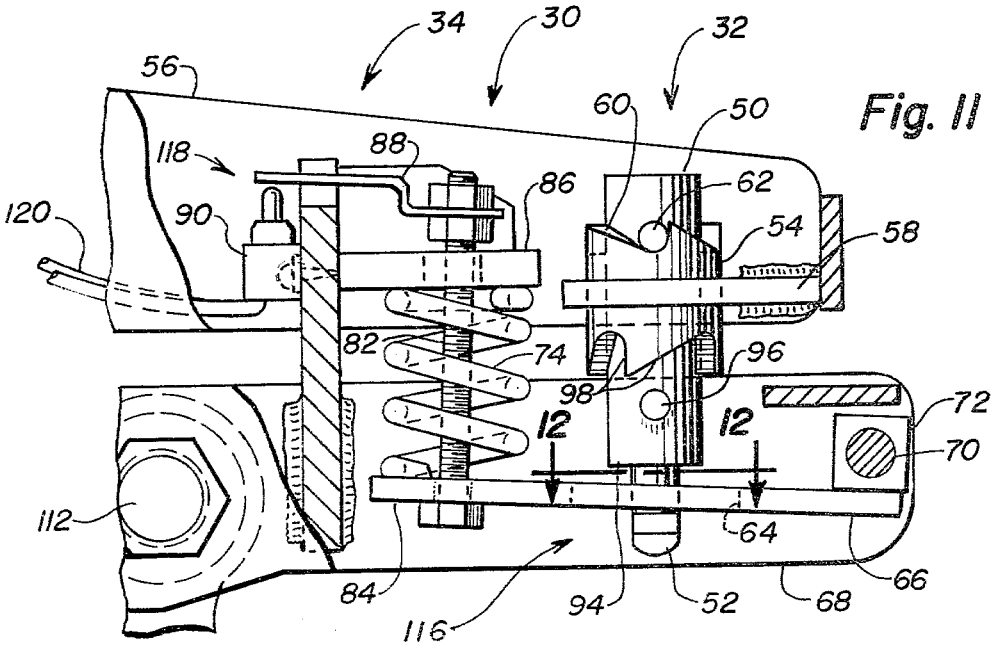
Fig. 11

MOTORIZED LEVER-ACTION VERTICAL AXIS COIL GRAB

BACKGROUND OF THE INVENTION

The instant invention pertains to a motorized lever-action vertical axis coil grab adapted to be employed in suspension from an overhead crane or other such materials handling equipment for manipulative operation by one individual from a remote control location, wherein said grab provides a combined electromechanical and pivotally linked self-gripping means for clampably engaging an upright standing coil of wrapped metal material, and thereafter securely retaining the same throughout crane elevation and movement from one location to another, further wherein the grab means structure hereof additionally embodies for operational enhancement purposes a tong latch sensing switch assembly automatically operable to de-energize the crane hoist motor and prevent elevation or movement of an improperly grab-engaged coil so as to thereby avoid encountering both the hazard and problem of a coil slipping apart and out of the gripping device clamps as is otherwise frequently resultant when a coil is engaged thereby but not held therein with sufficient compressive force.

In a general mechanical sense, the instant invention structurally relates to that type of coil lifting grab as taught in U.S. Pat. No. 3,153,555 to Kaplan et al dated Oct. 20, 1964, and variations thereon as further taught respectively in U.S. Pat. No. 2,536,932 to Heppenstall dated Jan. 2, 1951, U.S. Pat. No. 2,803,489 to Zito et al dated Aug. 20, 1957, U.S. Pat. No. 2,830,842 also to Heppenstall dated Apr. 15, 1958, and U.S. Pat. No. 3,037,806 dated June 5, 1962, and U.S. Pat. No. 3,076,674 dated Feb. 5, 1963, both of the latter to Anderson.

Alternative to the foregoing teachings, and that of the instant invention is the heavy duty coil grab device as taught in U.S. Pat. No. 2,906,555 to Heppenstall dated Sept. 29, 1959, or U.S. Pat. No. 2,945,609 to Benes et al dated July 19, 1960, which service capability the instant invention is able to provide without, however, the structural mass requirements otherwise necessary in a heavy duty grab.

Maintenance of grab balance in various configurations of use employment in accomplishing coil movement operations is another advantageous grab capability, and the teaching set forth in U.S. Pat. No. 2,370,528 to Fontaine dated Feb. 27, 1945, shows a coil grab device provided with an adjustable center of gravity means for maintenance of operational use employment balance.

The instant invention incorporates use of a lost motion slot structure for accommodating both re-cycle set of the grab prepatory to coil engagement re-use employment and to accommodate engagement of tightly wrapped coils, as contrasted to the so-called lost motion slots shown respectively in U.S. Pat. No. 2,535,911 to Frame dated Dec. 26, 1950, and U.S. Pat. No. 3,680,907 to Siegwart dated Aug. 1, 1972, the latter slot applications of which are necessary to accommodate structural relief of frictional binding build-up forces encountered in link member translational movement during routine coil engagement use employment of said latter mentioned grabs in operation and do not per se provide true "lost motion" functions.

The tong latch mechanism employed in the instant invention is structurally and functionally similar to those as respectively taught in U.S. Pat. No. 1,506,827 to Gellert dated Sept. 2, 1924, and U.S. Pat. No. 1,839,389 to Heppenstall dated Jan. 5, 1932, however, the additional embodiment in the instant invention of a spring operable load sensing switch with the tong latch is distinguished over those of such similar embodiments as respectively taught in U.S. Pat. No. 2,060,722 to Breslav dated Nov. 10, 1936, and U.S. Pat. No. 2,718,321 to Westermeyer dated Sept. 20, 1955.

Certain other similar structural and functional features of the instant invention, such as clamp shoes having pivotally compensating retaining capability being respectively taught in U.S. Pat. No. 2,374,120 to Mueller et al dated Apr. 17, 1945, and U.S. Pat. No. 2,974,995 to Calhoun dated Mar. 14, 1961, or means for locking the grab clamping jaws in compressed engagement with the engaged coil thickness section as respectively taught in U.S. Pat. No. 2,718,321 to Westermeyer dated Sept. 20, 1955, and U.S. Pat. No. 2,803,489 to Zito et al supra, are set forth in the above-cited prior art disclosures.

It should be understood that some of the features of the instant invention have, in some cases, structural and functional similarities to certain of those teachings separately set forth in the prior art disclosures heretofore cited and briefly discussed. However, as will hereinafter be pointed out, the instant invention is distinguishable from said earlier inventions in one or more ways in that the present invention has utility features and new and useful advantages, applications, and improvements in the art of motorized lever-action vertical axis coil grabs not heretofore known.

SUMMARY OF THE INVENTION

It is the principal object of the present invention to provide a motorized lever-action vertical axis coil grab embodying in combination a lever-acting force translating tong assembly having a pivotally joined linkage and tong latch structure which assembly supports a set of opposingly faced adjustably spaced compression clamps one such clamp of which set is displaceable towards and away from the other by motor-driven screw means, wherein the tong link structure comprising said assembly is adapted upon cycled tong latch release to move a pre-compressively engaged motor-driven clamping of the wall thickness of an upright standing wrapped coil at a point between the core radius and outer radius thereof by said compression clamps into increased lever-acting self-gripping force translated compressive engagement therewith when elevation thereof above a support surface by means such as an overhead crane or the like for accomplishing thereupon displacement of the coil-loaded grab from one location to another, and further, however, also embodying a load sensing switch means to automatically prevent operation of the overhead lifting crane when the tong latch mechanism of said assembly has not properly cycled to release the tong link structure for compound securement by lever-acting self-gripping compressive force translation clampable engagement of the motorized pre-clamped coil thereby insuring positive engagement of a coil to be lifted for movement and electromechanically preventing the lifting thereof if not properly engaged.

It is another object of the present invention to provide a motorized lever-action vertical axis coil grab having a tong link structure to compression clamp connective assembly which enables optimum translation of gravitational effect clamping power increase by maximizing the additive lever-acting combined weight self-gripping clamping force contribution of the grab structure and that of the particular coil being handled in pivotal tong link structure transmission through the coil core interior clamping shoe to thereby with greater efficiency clampably lock the coil in place such that as the more coil weight contribution applied to the tong linkage structure during that initial process of coil lifting, the compressive self-gripping force upon the coil between the clamps automatically increases proportionately to the incremental weight increase application thereto with a maximum self-gripping effect being realized upon free vertical suspension of an elevated coil in the grab.

It is a further object of the present invention to provide a motorized lever-action vertical axis coil grab wherein the coil core interior clamping shoe thereof is adapted to pivotally compensate in transmittal delivery of lever-acting self-gripping clamping force upon a motorized pre-squeezed non-spongy coil wall thickness clamped therebetween to thereby further enhance the compound lever-acting coil holding efficiency features thereof.

Still another object of the present invention is to provide a motorized lever-action vertical axis coil grab of moderate structural mass but of sufficiently enhanced lever factor efficiency as to be substantially capable of securely engaging and holding the convoluted laminate wrap structure of a coil solidly together so the same will not slip apart when being lifted above a support surface and thereafter during elevated transfer thereof from one location to another.

It is yet another object of the present invention to provide a motorized lever-action vertical axis coil grab having a center of gravity configuration such as to generally enable the working maintenance during operation of a relatively horizontal coil engaging disposition thereof when the same is suspended from an overhead crane or the like, whether the grab is empty or under load, or whether the motor-driven coil engaging compressive clamps thereof are in the open or closed positions.

It is additionally an object of the present invention to provide a motorized lever-action vertical axis coil grab wherein the same is adapted for crane-suspended utilization and single operator manipulation thereof from a remote crane control location.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 5 is an enlarged cut-away side elevation of the tong latch load sensing switch assembly corresponding to the retaining cycle configuration thereof as shown in FIG. 1.

FIG. 6 is a top plan view of the tong latch lug shown in FIG. 5 as seen along the line 6—6 thereof.

FIG. 7 is an enlarged cut-away side elevation of the tong latch load sensing switch assembly corresponding to the staged cycle configuration thereof as shown in FIG. 2.

FIG. 8 is a top plan view of the tong latch lug shown in FIG. 7 as seen along the line 8—8 thereof.

FIG. 9 is an enlarged cut-away side elevation of the tong latch load sensing switch assembly corresponding to the released cycle configuration thereof as shown in FIG. 3.

FIG. 10 is a top plan view of the tong latch lug shown in FIG. 9 as seen along the line 10—10 thereof.

FIG. 11 is an enlarged cut-away side elevation of the tong latch load sensing switch assembly corresponding to the engaged restrained cycle configuration thereof as shown in FIG. 4.

FIG. 12 is a top plan view of the tong latch lug shown in FIG. 11 as seen along the line 12—12 thereof.

DETAILED DESCRIPTION OF THE INVENTION

Figure 1:
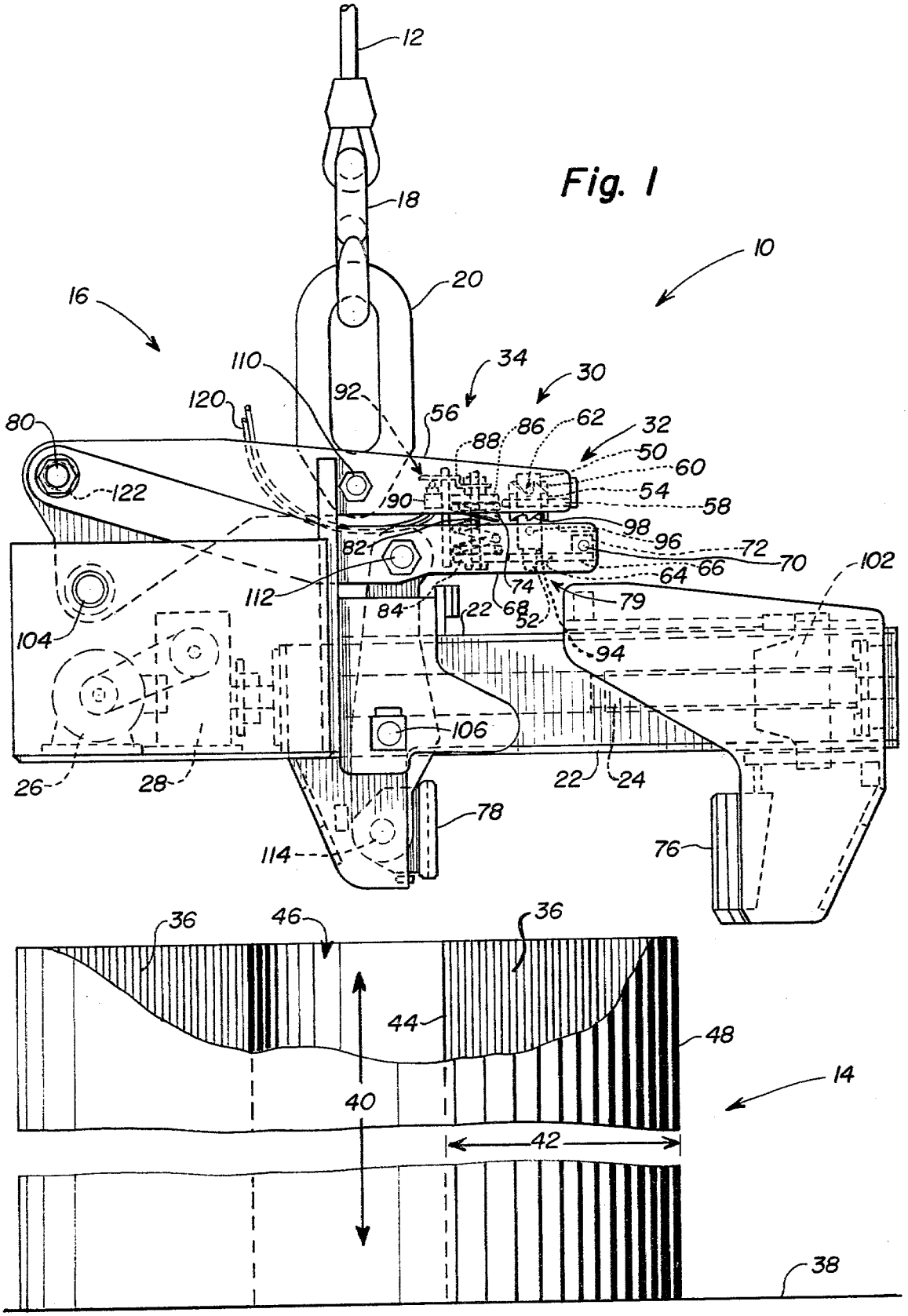
FIG. 1 is a side elevation of the motorized lever-action vertical axis coil grab comprising the instant invention, the same being shown suspended from an overhead crane cable in a position proximately above an exemplary upright standing wrapped metal material coil, wherein illustration of the latter has been foreshortened to accommodate the sheet and further wherein said coil grab is disposed with the pivotally joined tong link structure thereof held in a retracted position by the tong latch in retaining cycle configuration and the opposingly faced adjustably spaced compression clamps thereof are opened preparatory to accomplishment of coil load engagement for crane elevation and displacement thereby.

Referring to FIG. 1, the present invention is shown which comprises a motorized lever-action vertical axis coil grab 10 operably suspended from an overhead crane cable 12 and positioned in proximate disposition above an exemplary upright standing wrapped metal material coil 14 preparatory to accomplishment of compressive clampable engagement of said coil 14 by said grab 10 for crane elevation and relocation movement thereby, said grab 10 having as components thereof a lever-acting force translating tong assembly 16 connected in suspension from said overhead crane cable 12 by means of intercommunicative engagement of crane hook 18 with pivot shackle 20 and dependently supporting in pivotal tong link connection therewith a horizontal frame member 22 mounting therefrom a set of opposingly faced adjustably spaced coil compression clamp means being variably spaceable laterally by motor-driven screw means 24 driven off reversable motor 26 through right-angle gear box 28, wherein said lever-acting force translating tong assembly 16 is releasably operable to clamp said coil 14 with increased lever-acting self-gripping force translated compressive engagement through cycled operation so as not to cause engagement of the tong latch load sensing switch assembly 30 in turn comprised of a tong latch mechanism 32 in combination with a load sensing switch means 34, unless, however, an overload condition exists.

Referring again to FIG. 1 to describe in greater detail the component parts of this invention as well as explain the operation thereof in accomplishing coil 14 elevation and movement operations, wherein it is to be understood that said coil 14 is that type of coil commonly referred to as an upright standing coil, i.e., a coil formed by wrapping under tension a ribbon of metal material such as aluminum or the like to provide a relatively tight wrap of successive convoluted ribbon overplys 36 wherein the coil thus formed is adapted to be set upon a horizontally disposed support surface 38 for the purposes of storage or the like, with the central core axis 40 thereof being vertically disposed to said support surface 38, thus upwardly presenting for coil engagement by grab means for purposes of lifting and movement operations the convoluted coil wrap wall thickness 42 with coil interior wall surface 44 access being provided by the central coil core opening 46 and the coil exterior wall surface 48 thereof being openly exposed outwardly for access. With the foregoing in mind as respects physical configuration of the load to be handled, the coil grab 10 of the instant invention operates as follows.

Initially, prior to and preparatory for coil engagement operations the lever-acting force translating tong assembly 16 of the coil grab 10 is positioned and retained in a retracted configuration as shown in FIG. 1, being accomplished by means of the tong latch mechanism 32, wherein the tong latch cam bolt 50 thereof dependently supporting cam bolt lug head 52 rotationally and reciprocally within barrel cam collar 54 fixedly assembled to the non-pivot outboard lever-arm end of the uppper tong link 56 of said tong assembly 16 by means of tong latch mounting bracket 58 weldment is cycled by tong latch upper barrel cam follower pins 62 also supported by said tong latch cam bolt 50 whereby the elongated axis of said cam bolt lug head 52 is downwardly disposed perpendicular of the long axis of the slot 64 centrally intermediate the load sensing switch pivot plate 66 pivotally assembled to the non-pivot outboard end of the lower tong link 68 of said assembly 16 by means of pivot pin 70 and gudgeon 72, and in upward compressive engagement therewith against pivotally extensive force of the load sensing switch compression spring 74 to thereby prevent extension of said tong assembly 16 in self-gripping function as hereinafter explained and also thereby permit positioning for initial motorized compressive engagement of the convoluted coil wrap wall thickness 42 of said coil 14 by opposingly faced adjustably spaced coil compression clamp means of said instant invention 10 being respectively coil exterior clamping shoe 76 and coil core interior clamping shoe 78 variably spaceable laterally by motor-driven screw means 24. In effect, then, the lever-acting force translating tong assembly 16 as shown in FIG. 1 in the retracted configuration is held in a stabilized "cocked" position 79 for load egagement by engagement of the tong latch mechanism 32 with the load sensing switch pivot plate 66 respectively fixedly assembled to the non-pivot outboard lever-arm upper tong link 56 and the lower tong link 68 ends both of which link members are in turn pivotally joined at the ends opposite thereto by connecting pivot bolt 80 insertably communicating connectably through openings respectively therein. It should be noted at this point that the load sensing switch compression spring 74 adjustably held in position by spring guide bolt 82 between the latch pivot plate pivot deflection end 84 and the compression spring upper retaining bracket 86 is rated so as not to deflect under the engaged tong latch 32 through load sensing switch pivot plate 66 upward communicated tare or "dead" weight load thrust of the coil grab 10 per se, and thereby does not deflect the switch lever 88, also adjustably assembled to the upper end of the spring guide bolt 82, whereby the normally open crane hoist motor load sensing latch switch 90 is maintained in the closed contact position 92 as shown thereby enabling crane driven maneuvered positioning of said coil grab 10 relative to the coil 14 load to be engaged for elevation and movement.

A more detailed illustration of the tong latch load sensing switch assembly 30 cooperative components as above-described with reference to FIG. 1, corresponding to a tong latch upper barrel cam 60 cycled functioning thereof in the stabilized "cocked" position 79 configuration preparatory to engagement positioning of the coil grab 10 hereof upon a coil 14 to be lifted and moved, is shown in the enlarged cut-away side elevation of FIG. 5, with a showing of the elongated axis of the cam bolt lug head 52 of the tong latch mechanism 32 downwardly disposed perpendicular of the long axis of the slot 64 centrally intermediate the load sensing switch pivot plate 66 being as illustrated in the top plan view of FIG. 6 taken along the line 6—6 of FIG. 5.

The mechanical components of coil grap 10 hereof as disclosed in FIG. 1, and supplementally detailed in FIG. 5 and FIG. 6, are preferably constructed from metal alloy materials, however, any other suitable materials or combinations thereof may be used.

Figure 2:
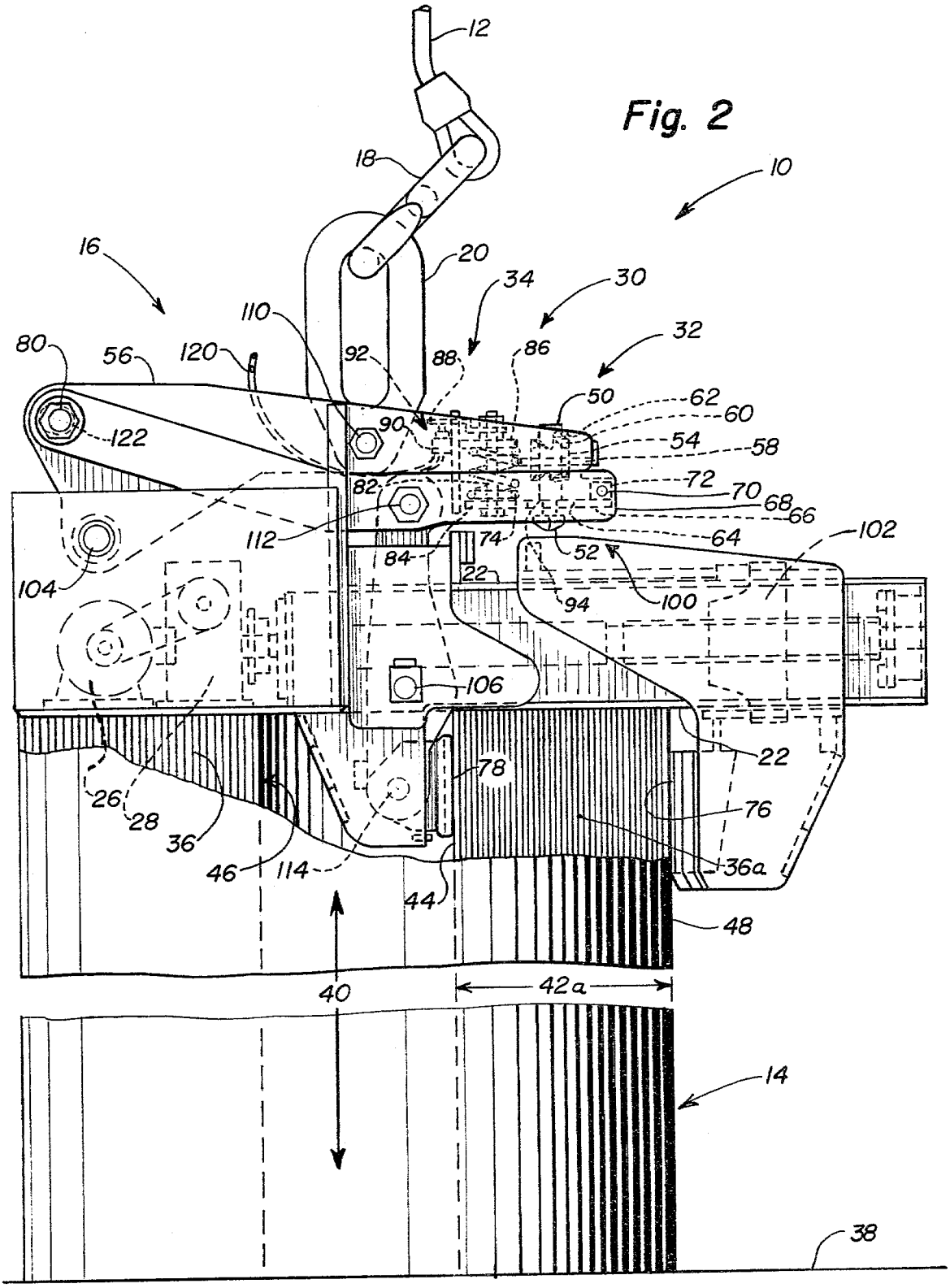
FIG. 2 is a side elevation of the motorized lever-action vertical axis coil grab comprising the instant invention being somewhat similar to that as previously illustrated in FIG. 1, but, however, in this view showing the component assemblies thereof wherein the same are disposed in a motor-driven compression clamp engagement of the wall thickness of said exemplary upright standing wrapped metal material coil to thereby pre-squeeze the same sufficiently to substantially remove any wrap slack sponginess from the convoluted laminate overply structure thereof, with the tong latch positioned in staged cycle configuration prepatory to liftable engagement of said coil by released tong latch employment of the lever-acting force translating tong assembly of said coil grab.

Referring now to FIG. 2 to describe accomplishment of motorized compressive clampable engagement by grab 10 of the coil 14 to be lifted for movement, wherein it will be seen that said grab 10 has been lowered by the overhead crane means into a position of support by horizontal frame member 22 upon the top of coil 14, with the convoluted coil wrap wall thickness thereof interposed intermediate the respective and opposedly variably spaced clamping faces of coil exterior clamping shoe 76 and coil core interior clamping shoe 78, further with a sufficient overhead crane lowering thereafter of cable 12 to cause slackening therein whereupon the upper tong link 56 is free to rotate about the connecting pivot bolt 80 and in so doing causes the tong latch cam bolt retaining shoulder 94 to drop into supportable contact with the upper surface of load sensing switch pivot plate 66, and, relative to barrel cam collar 54 be elevated with respect thereto such that the lower barrel cam follower pins 96 engage and trace the tong latch lower barrel cam 98 surface thus causing rotation of the cam bolt lug head 52 elongated axis angularly intermediate a position perpendicular and parallel to the long axis of the slot 64, being substantially an angle of forty-five degrees more-or-less, being also the tong latch mechanism 32 lever-acting force translating tong assembly stage position 100, in which position the tong link and suspension structure is mechanically configured to enable motorized clamping shoe compressive engagement of the convoluted coil wrap wall thickness dimension.

As previously pointed out, the coil 14 is formed by wrapping under tension a ribbon of metal material, however, inherent to such a coil forming process there is a resultant wrap slack sponginess in the convoluted coil wrap wall thickness 42, which sponginess is substantially removed therefrom by motorized compressive clampable engagement thereof by said opposedly variably spaced clamping faces of coil exterior clamping shoe 76 and coil core interior clamping shoe 78 thereby to present for subsequently cycled increased lever-acting self-gripping force translated compressive grab engagement a substantially compacted, i.e., solid, motorized grab clamped convoluted coil wrap ribbon overply 36*a* having wall thickness 42*a* accomplished as follows.

The reversable motor 26 is activated from a remote crane control location to power motor-driven screw means 24 through rightangle gear box 28 and thereby screwably draw forward threadably communicating exterior clamping shoe adjustment block 102 thus causing motorized compressive clamping of the convoluted coil wrap wall thickness between the adjustable coil exterior clamping shoe 76 and relatively fixed coil core interior clamping shoe 78 to a point of motor stall thereby removing therefrom substantially all wrap slack sponginess, being the resultant motorized grab clamped convoluted coil wrap wall thickness 42*a*, at which point the grab 10 is mechanically readied for cycle to increased lever-acting self-gripping force translated compressive grab 10 engagement whereupon overhead crane elevation and movement of coil 14 may thereby be expeditiously accomplished.

A more detailed illustration of the tong latch load sensing switch assembly 30 cooperative components as above-described with reference to FIG. 2, corresponding to a tong latch lower barrel cam 98 cycled functioning thereof in the lever-acting force translating tong assembly stage position 100 preparatory to subsequent cycling for increased lever-acting self-gripping force translated compressive grab 10 engagement of a coil 14 to be lifted and moved, is shown in the enlarged cutaway side elevation of FIG. 7, with a showing of the elongated axis of the cam bolt lug head 52 of the tong latch mechanism 32 being substantially at an angle of forty-five degrees more-or-less to the long axis of the slot 64 centrally intermediate the load sensing switch pivot plate 66 being as illustrated in the top plan view of FIG. 8 taken along the line 8—8 of FIG. 7.

Figure 3:
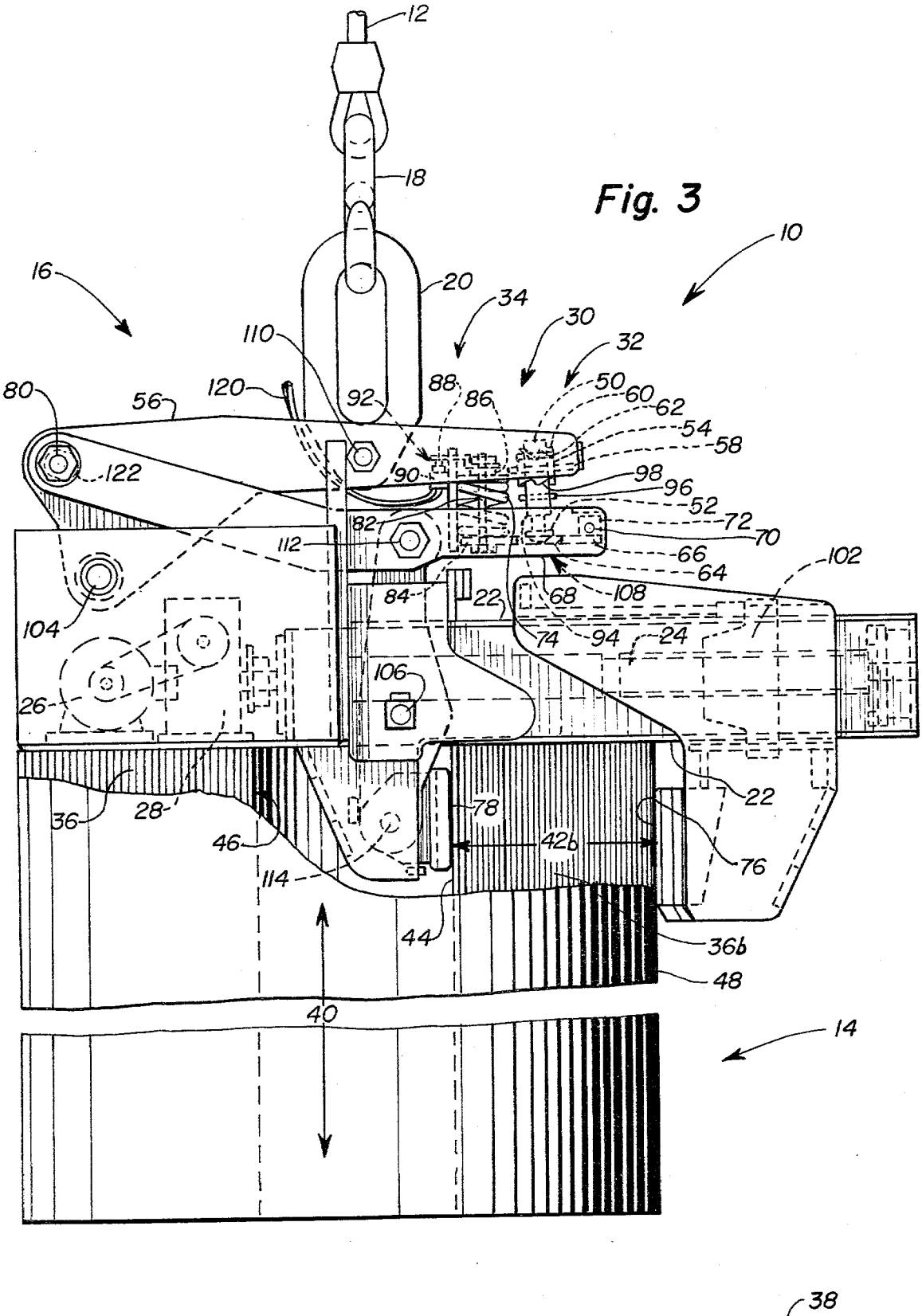
FIG. 3 is a side elevation of the motorized lever-action vertical axis coil grab wherein the component assemblies thereof are disposed with the tong latch in released cycle configuration and the coil retainably engaged by the compression clamps under increased lever-acting self-gripping grab force in an elevated position above the support surface for crane displaced movement to another location.

With the coil grab 10 structure configured in a lever-acting force translating tong assembly stage position 100, and motorized clampable engagement of a coil 14 having been accomplished to thereby substantially remove therefrom any wrap slack sponginess, the coil grab 10 is then readied to accomplish force translating tong assembly 16 releasably operable clamping of said coil 14 with increased lever-acting self-gripping force translated compressive engagement by that force created and comprised of the additive effects of the coil grab 10 dead weight per se plus the coil 14 weight operating through the tong link compound lever-arm structure respectively about primary and secondary tong link fulcrum pivots 104 and 106 all as shown in FIG. 3 and more specifically described as follows.

The overhead crane cable 12 is withdrawn upward to remove slack therefrom and then elevated further to also cause pivotal raising of the upper tong link 56 about the connecting pivot bolt 80 which simultaneously slidably elevates the barrel cam collar 54, secured to said upper tong link 56 by weldment of tong latch mounting bracket 58 thereto as previously described, circumferentially about the tong latch cam bolt 50 to that point where two of the uppermost oppositely positioned downward leading surfaces of tong latch upper barrel cams 60 engae the outwardly extending upper barrel cam follower pins 62 and thereupon cause rotatable elevation of the tong latch cam bolt 50 to bottom stop points of the tong latch upper barrel cams 60 as shown whereupon the cam bolt lug head 52 elongated axis is aligned with the slot 64 along axis and thereupon cleared to be upwardly withdrawn therethrough during continued elevation of said overhead crane cable 12 also as shown, at which point transition from motorized compressive clampable engagement to lever-acting self-gripping force of the coil 14 commences, being the tong latch mechanism release position 108.

A more detailed illustration of the tong latch load sensing switch assembly 30 cooperative components as above-described with reference to FIG. 3, corresponding to a tong latch mechanism 32 cycling to the release position 108 for transition from motorized compressive clampable engagement to commencement of lever-acting self-gripping force of the coil 14, is shown in the enlarged cutaway side elevation of FIG. 9, with a showing of the elongated axis of the cam bolt lug head 52 of the tong latch mechanism 32 upwardly withdrawn in long axis alignment through slot 64 being as illustrated in the top plan view of FIG. 10 taken along the line 10—10 of FIG. 9.

Upon clearing of the cam bolt lug head 52 upwardly through slot 64, and continued elevation of the overhead crane cable 12, the upper tong link 56 rotates upwardly from pivot shackle connection bolt 110 about the primary tong link fulcrum pivot 104 to thereby translate an outward pushing force on the lower tong link 68 through connecting pivot bolt 80 thereby exerting a pulling force pivotally translated through the lower tong link connecting pivot bolt 112 about the secondary tong link fulcrum pivot 106 to exert an increasing lever-acting self-gripping compressive coil clamping force upon progressive coil load plus grab dead weight translation as there is an elevation of coil 14 retained through coil core interior clamping shoe 78 to coil exterior clamping shoe 76, said increasing lever-acting self-gripping compressive coil clamping force being exerted self-adjustably in pivotal compensation through interior clamping shoe pivot 114 upon interposed lever-action grab clamped convoluted coil wrap wall thickness 42*b* thereby enabling overhead crane elevation and movement of said coil 14 without that hazard of having the lever-action clamped wrap of successive convoluted ribbon overplys 36*a* slipping apart upon lifting above and elevated displacement movement thereof over the horizontally disposed support surface 38. It is by manipulation and mechanism of the foregoing mechanical sequence that said motorized lever-action vertical axis coil grab 10 normally operates during employment thereof in accomplishing engagement, elevation, and movement operations as applied to upright standing wrapped metal material coils 14.

Figure 4:
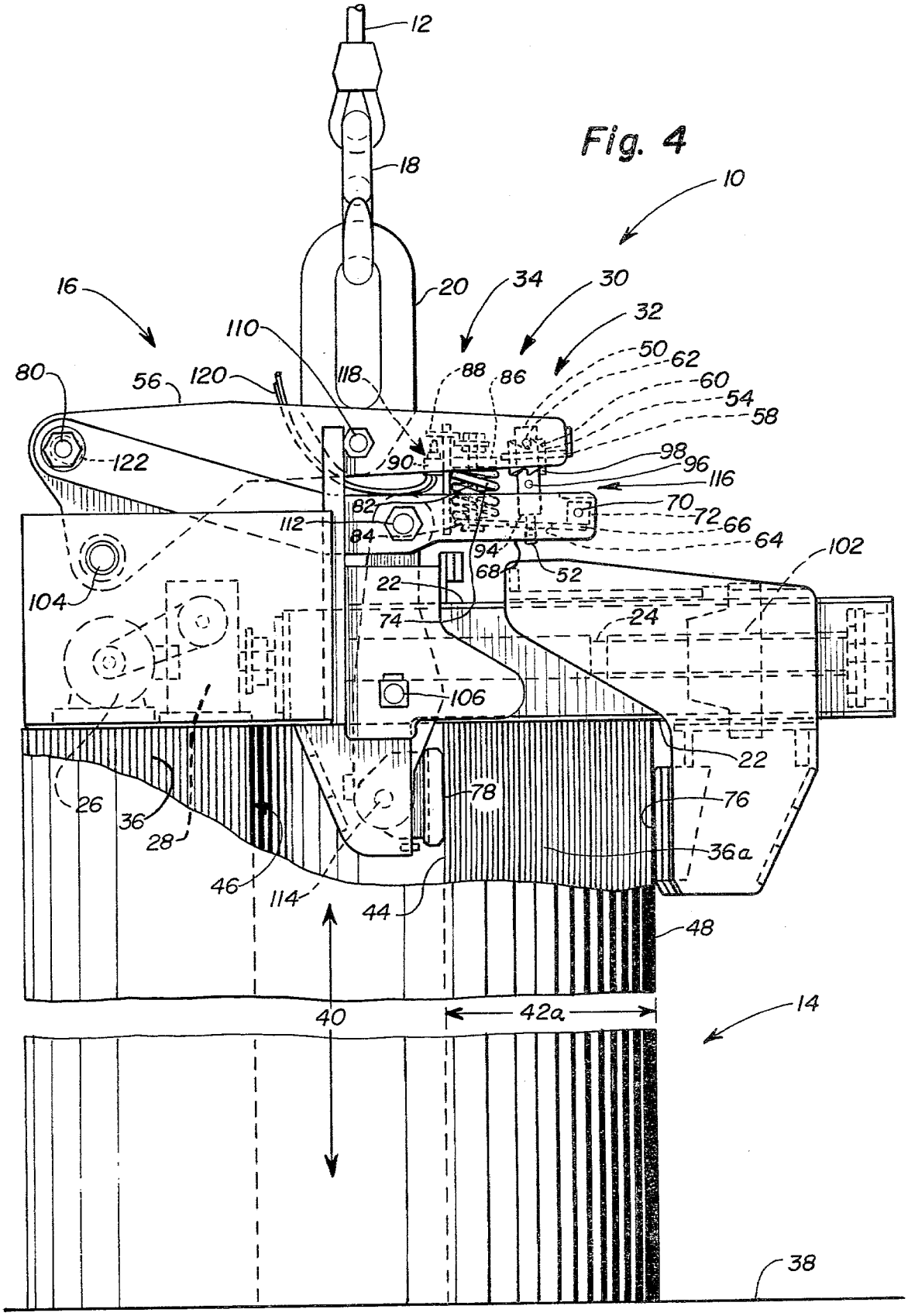
FIG. 4 is a side elevation of the motorized lever-action vertical axis coil grab wherein the component assemblies thereof are disposed with the tong latch in engaged restrained cycle configuration.

On occasion, however, either initially or intermediate during coil handling operations with said grab 10 such as when an operator would set the engaged coil upon a support surface after initial elevation and movement but prior to final positioning placement thereof, the lever-acting force translating tong assembly 16 may slightly collapse, from the extended configuration thereof as heretofore described, as a consequence of inadvertent overhead crane cable 12 slackening, which may thereupon result in partial pivotal closing of the upper tong link 56 whereupon a re-entry of the cam bolt lug head 52 downward through the slot 64 and index camming thereof to the lever-acting force translating tong assembly restrained engagement position 116 whereupon any subsequent attempt to elevate the motorized clamped coil will cause cam bolt lug head 52 pivotal upward re-engagement with and deflection of the load sensing switch pivot plate 66 about the pivot pin 70 as a result of the combined force effects of the grab dead weight and the coil weight over-load upon the load sensing switch compression spring 74, which spring is rated to restrain without deflection the coil grab 10 dead weight only, thus causing compression thereof and deflection of the switch lever 88 thereby operating the normally open crane hoist motor load sensing latch switch 90 to the switch open position 118 thus breaking the crane hoist motor power circuit through switch conduits 120 to automatically and electromechanically prevent the inadvertent elevation for movement of a coil 14 which is not properly secured by lever-acting self-gripping clamp compression, and thereby also preventing the hazard of having a coil 14 slip apart upon elevation as a result of either inadequate or improper compressive clamp engagement thereof, all as illustrated in FIG. 4, showing the coil 14 remaining in deposit upon the horizontally disposed support surface 38.

A more detailed illustration of the tong latch load sensing switch assembly 30 cooperative components as above-described with reference to FIG. 4, corresponding to a tong latch upper barrel cam 60 cycled functioning thereof in the lever-acting force translating tong assembly restrained engagement position 116 configuration to electromechanically prevent elevation of coil 14 for movement by said grab 10 is shown in the enlarged cut-away side elevation of FIG. 11, with a showing therein also of the normally open crane hoist motor load sensing latch switch 90 in the switch open position 118 whereby power to the crane hoist motor through switch conduits 120 is broken. The top plan view shown in FIG. 12, taken along the line 12—12 of FIG. 11, illustrates pivotal downward deflective engagement configuration of the cam bolt lug head 52 with the load sensing switch pivot plate 66 when the same are cycled into the lever-acting force translating tong assembly restrained engagement positon 116.

It should be noted that re-cycling of the motorized lever-action vertical axis coil grab 10 to re-set for accomplishment of initial load engagement operations with respect to an upright standing wrapped metal material coil 14 as previously discussed and illustrated in and on consideration of FIG. 1, to which reference is now again made, is simply accomplished from the lever-acting self-gripping extended tong configuration as illustrated in FIG. 3 by permitting full slackening of the overhead crane cable 12 as shown in FIG. 2 and then elevating by means of the overhead crane to the grab 10 free suspension configuration as shown in FIG. 1, through which sequence barrel cam collar 54 cycles the tong latch cam bolt 50 during normal operational use employment of grab 10 in coil 14 handling operations whereby the cam bolt lug head 52 is configured to the tong assembly 16 stabilized "cocked" position 79 as further detailed respectively in previously discussed FIGS. 5 and 6, in which respect the upper tong link 56 by means of an elongated "lost motion" opening 122 therein being communicative about insertably connecting pivot bolt 80 as shown mechanically provides that tong link assembly controlled lost motion latitude necessary further whereby said grab 10 tong latch load sensing switch assembly 30 and the tong latch mechanism 32 thereof is reset.

An additional tong link assembly controlled motion operational latitude provided by elongated lost motion opening 122 is in the event, and upon motorized clampable engagement, of a compactly wrapped coil having little, or relatively speaking no, wrap slack sponginess therein whereby any tong link structure reverse movement transmission, consequent therefrom is compensated within said elongated lost motion opening 122 and not translated to the tong latch mechanism 32 whereby clearance of the cam bolt lug head 52 with the slot 64 in such an event, upon proper operational sequence cycling, is maintained.

Although the invention has been herein shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus.

I claim:

1. A motorized lever-action vertical axis coil grab adapted to be operably employed and controlled from a remote location in suspension from an overhead crane for use in compressively engaging for elevation and movement thereof from one location to another by means of said overhead crane at least one of a plurality of upright standing wrapped metal material coils disposed upon a horizontal support surface within the operable range vicinity of said overhead crane, said motorized lever-action vertical axis coil grab comprising in combination:

(a) a tong link support structure having respectively a pivotally interconnected angularly disposed upper tong link connectably communicating with a lower tong link about a lost motion pivot juncture therebetween vicinity one of the laterally disposed ends thereof said upper tong link in turn having pivotally connected intermediate the respective laterally disposed ends thereof a pivot shackle adapted to be communicatively interconnected upwardly in dependent suspension from an overhead crane cable hook and said lower tong link supporting in pivotally connected dependence therefrom also intermediate the respective laterally disposed ends thereof a horizontal frame member with an additional cooperative pivotal connection of a downward disposed portion of said upper tong link also therewith dependently from said one of the laterally disposed ends thereof vicinity of said lost motion pivot juncture, (b) a set of dependently disposed clamping shoes movably supported within said horizontal frame member wherein a first shoe of said set is laterally disposed outwardly on said horizontal frame member the end opposite said one of the laterally disposed ends and is provided with an adjustment means for laterally displaceable longitudinal movement thereof with respect to a second shoe of said set which is pivotally disposed centrally intermediate the laterally disposed ends of said horizontal frame member and in turn laterally displaceable pivotally in tong link support structure translated angular movement with respect to said first shoe of said set, and (c) a tong latch assembly comprised of a tong latch mechanism affixed the end opposite said one of the laterally disposed ends of said upper tong link and having a mechanical means cooperatively operable, subsequent to a clampable engagement of an upwardly disposed wall thickness segment of one of said coils compressively interposed said set of dependently disposed clamping shoes through lateral displacement of said first shoe with said adjustment means towards said second shoe upon said wall thickness segment therebetween in accomplishing a pre-compressed removal of coil wrap slack sponginess from the convoluted overply structure thereof, in releasing said tong link support structure of said coil grab and thereby effect a pivotally translated lever-acting self-gripping compressive force to said clamping shoes upon said pre-compressed wall thickness segment therebetween by a combined tong link tare plus coil weight translated force operable through pivotal angular movement lateral displacement of said second shoe of said set of dependently disposed clamping shoes towards said first shoe thereof to clampably engage by means of said lever-acting self-gripping tong link structure compressive force translation said coil for elevation and movement thereby.

2. A motorized lever-action vertical axis coil grab according to claim 1 in which said lost motion pivot juncture of said tong link support structure is provided with an elongated oval opening in the upper tong link at a parallel elongated axis disposition to the longitudinal dimension thereof to thereby provide that means whereby a controlled lost motion latitude necessary to accomplish a re-set cycle of said coil grab for coil engagement is accomplished.

3. A motorized lever-action vertical axis coil grab according to claim 2 wherein said lost motion pivot juncture of said tong link support structure further provides that means whereby a controlled lost motion latitude necessary to enable a proper operational cycling of said tong latch without a tong link structure reverse movement transmission binding thereof upon a pre-compressed engagement of an already compactly wrapped metal material coil having substantially no slack wrap sponginess therein.

4. A motorized lever-action vertical axis coil grab according to claim 1 in which said first shoe adjustment means is a motor-driven screw threadably communicating through a shoe adjustment block disposed at the end opposite said one of the laterally disposed ends and connected to a reversable drive motor through a right-angle gear box at the other end thereof whereby laterally displaceable longitudinal movement of said first shoe is accomplished.

5. A motorized lever-action vertical axis coil grab having a tong latch load sensing switch assembly operable to terminate said coil grab prime movement means power upon restraint from release of a tong link structure of said coil grab, said tong latch load sensing switch assembly comprising in combination a tong latch mechanism provided with a barrel cam adapted to rotationally and reciprocally drive a cam bolt having an elongated geometrically shaped lug head cooperatively operable with a load sensing switch pivot plate provided with a complementary elongated geometrically shaped opening centrally intermediate therein adapted to cooperatively receive reciprocally therethrough said elongated lug head when cammably cycled by said barrel cam to be on alignment therewith, said pivot plate being pivotally affixed one end thereof and positioned with the other end thereof to communicate deflectively upward against a pivot deflection resistive compression spring of a load sensing switch means operable to cause a power terminating opening upon retractive deflection thereof a closed normally open switch with upward deflective movement of said load sensing switch pivot plate about the pivotal affixment thereof by means of an overload force upon said coil grab communicated thereto by restrained inaction of said tong link structure thereof upon a non-complementary elongated lug head configuration therewith after being received through said load sensing switch pivot plate elongated geometrically shaped opening and upon a barrel cam reciprocally driven retraction upwardly thereagainst of a force sufficient to cause retractive deflection of said spring, being said overload force, to thereupon cause said coil grab prime movement means to become inoperative.

6. A motorized lever-action vertical axis coil grab adapted to be operably employed and controlled from a remote location in suspension from an overhead crane for use in compressively engaging for elevation and movement thereof from one location to another by means of said overhead crane at least one of a plurality of upright standing wrapped metal material coils disposed upon a horizontal support surface within the operable range vicinity of said overhead crane, said motorized lever-action vertical axis coil grab comprising in combination:

(a) a tong link support structure having respectively a pivotally interconnected angularly disposed upper tong link connectably communicating with a lower tong link about a lost motion pivot juncture therebetween vicinity one of the laterally disposed ends thereof said upper tong link in turn having pivotally connected intermediate the respective laterally disposed ends thereof a pivot shackle adapted to be communicatively interconnected upwardly in dependent suspension from an overhead crane cable hook and said lower tong link supporting in pivotally connected dependence therefrom also intermediate the respective laterally disposed ends thereof a horizontal frame member with an additional cooperative pivotal connection of a downward disposed portion of said upper tong link also therewith dependently from said one of the laterally disposed ends thereof vicinity of said lost motion pivot juncture, (b) a set of dependently disposed clamping shoes movably supported within said horizontal frame member wherein a first shoe of said set is laterally disposed outwardly on said horizontal frame member the end opposite said one of the laterally disposed ends and is provided with an adjustment means for laterally displaceable longitudinal movement thereof with respect to a second shoe of said set which is pivotally disposed centrally intermediate the laterally disposed ends of said horizontal frame member and in turn laterally displaceable pivotally in tong link support structure translated angular movement with respect to said first shoe of said set, (c) a tong latch load sensing switch assembly comprised of a tong latch mechanism affixed the end opposite said one of the laterally disposed ends of said upper tong link and having a mechanical means cooperatively operable with a load sensing switch pivot plate provided with a slotted opening centrally intermediate therein and pivotally affixed the end opposite said one of the laterally disposed ends of said lower tong link laterally outward of said tong latch mechanism and having a deflection end positioned to communicate pivotally upward against a resistive compression spring of a load sensing switch means all in combination comprising said tong latch load sensing switch assembly being operable, subsequent to a clampable engagement of an upwardly disposed wall thickness segment of one of said coils compressively interposed said set of dependently disposed clamping shoes through lateral displacement of said first shoe with said adjustment means towards said second shoe upon said wall thickness segment therebetween in accomplishing a pre-compressed removal of coil wrap slack sponginess from the convoluted overply structure thereof, in releasing said tong link support structure of said coil grab and thereby effect a pivotally translated lever-acting self-gripping compressive force to said clamping shoes upon said pre-compressed wall thickness segment therebetween by a combined tong link tare plus coil weight translated force operable through pivotal angular movement lateral displacement of said second shoe of said set of dependently disposed clamping shoes towards said first shoe thereof, and (d) a closed normally open crane hoist motor load sensing switch operable only to open upon deflection of a switch lever communicably cooperative by a connection means with upward movement of said deflection end of said load sensing switch pivot plate about the pivotal affixment thereof by means of an overload force communicated thereto through said tong latch mechanism affixed said upper tong link and operable against said resistive compression spring to cause compression thereof and thereby break power transmission through a communicating circuit to the crane hoist motor and also thereby automatically prevent the elevation and movement of a coil not properly engaged by said coil grab as a consequence of incomplete sequential operational cycling of said tong latch mechanism to effect a lever-acting self-gripping tong link structure compressive force translation.

7. A motorized lever-action vertical axis coil grab according to claim 6 in which said lost motion pivot juncture of said tong link support structure is provided with an elongated oval opening in the upper tong link at a parallel elongated axis disposition to the longitudinal dimension thereof to thereby provide that means whereby a controlled lost motion latitutde necessary to accomplish a re-set cycling of said coil grab for coil engagement is accomplished.

8. A motorized lever-action vertical axis coil grab according to claim 7 wherein said lost motion pivot juncture of said tong link support structure further provides that means whereby a controlled lost motion latitude necessary to enable a proper operational cycling of said tong latch without a tong link structure reverse movement transmission binding thereof upon a pre-compressed engagement of an already compactly wrapped metal material coil having substantially no slack wrap sponginess therein.

9. A motorized lever-action vertical axis coil grab according to claim 6 in which said first shoe adjustment means is a motor-driven screw threadably communicating through a shoe adjustment block disposed at the end opposite said one of the laterally disposed ends and connected to a reversable drive motor through a right-angle gear box at the other end thereof whereby laterally displaceable longitudinal movement of said first shoe is accomplished.

10. A motorized lever-action vertical axis coil grab according to claim 6 in which said resistive compression spring has a compression resistance rating so as to withstand compressive deflection under the tong link structure to load sensing switch pivot plate transmitted weight force effect of the coil grab tare weight per se.

11. A motorized lever-action vertical axis coil grab according to claim 10 in which said compression resistance rating of said resistive compression spring will enable deflective yielding under the tong link structure to load sensing switch pivot plate transmitted combined weight force effect of the coil grab tare weight plus that weight of an improperly engaged upright standing wrapped metal material coil when added thereto.

* * * * *